US006107580A

United States Patent [19]

Hoshikawa et al.

[11] Patent Number: 6,107,580

[45] Date of Patent: Aug. 22, 2000

[54] OMNIDIRECTIONAL RESPONSE CABLE SWITCH

[75] Inventors: Kyofu Hoshikawa; Seishiro Ishiwatari; Mitsuru Tanahashi; Tadamitsu Sasaki, all of Tokyo, Japan

[73] Assignee: Shinmei Rubber Industries Co., Ltd., Tokyo, Japan

[21] Appl. No.: 09/247,014

[22] Filed: Feb. 9, 1999

[30] Foreign Application Priority Data

| | | | |
|---|---|---|---|
| Feb. 9, 1998 | [JP] | Japan | 10-040978 |
| Mar. 27, 1998 | [JP] | Japan | 10-098235 |
| Apr. 20, 1998 | [JP] | Japan | 10-109065 |
| Apr. 30, 1998 | [JP] | Japan | 10-120629 |
| Sep. 2, 1998 | [JP] | Japan | 10-248132 |

[51] Int. Cl.[7] ..... H01H 3/16; H01H 35/00

[52] U.S. Cl. ..... 200/61.43; 200/85 R; 200/86 R

[58] Field of Search ..... 200/5 A, 61.43, 200/61.44, 86 R, 511, 85 R

[56] References Cited

U.S. PATENT DOCUMENTS

| | | | |
|---|---|---|---|
| 4,497,989 | 2/1985 | Miller | 200/86 R |
| 4,687,200 | 8/1987 | Shirai | 200/5 A X |
| 4,742,196 | 5/1988 | Kelly | 200/86 R |
| 5,023,418 | 6/1991 | Beckhausen | 200/511 |
| 5,072,080 | 12/1991 | Beckhausen | 200/61.43 |
| 5,296,658 | 3/1994 | Kramer et al. | 200/61.43 |
| 5,728,983 | 3/1998 | Ishihara et al. | 200/61.43 |
| 5,780,793 | 7/1998 | Buchholz et al. | 200/61.44 |
| 5,834,719 | 11/1998 | Kaji et al. | 200/61.44 |

FOREIGN PATENT DOCUMENTS

| | | |
|---|---|---|
| 5-190055 | 7/1993 | Japan . |
| 7-7033 | 1/1995 | Japan . |
| 7-7035 | 1/1995 | Japan . |

*Primary Examiner*—J. R. Scott

*Attorney, Agent, or Firm*—Jacobson, Price, Holman & Stern, PLLC

[57] ABSTRACT

This invention provides an omnidirectionally responsive cable switch (5) capable of snake-like or twisted wiring or layout and comprising a tubular outer cover (1) made of an insulating material and 2–4 separate conductive rubbers (3*a*–3*d*) fixed on the inner surface of the outer cover leaving an air gap (2) therebetween, the separate conductive rubbers being spaced apart from each other, and the outer cover being capable of being distorted together with the conductive rubbers so that the separate conductive rubbers may contact with each other when substantial compressive pressure is applied thereon at any point of the outer cover, thereby forming a switching contact therebetween. The air gap (2) may be substantially of a cross-shaped, Y-shaped, V-shaped, S-shaped, or arrow-head-shaped form. The omnidirectionally responsive cable switch may be further protected or guarded by a reinforcing member or material.

10 Claims, 9 Drawing Sheets

FIG. 13
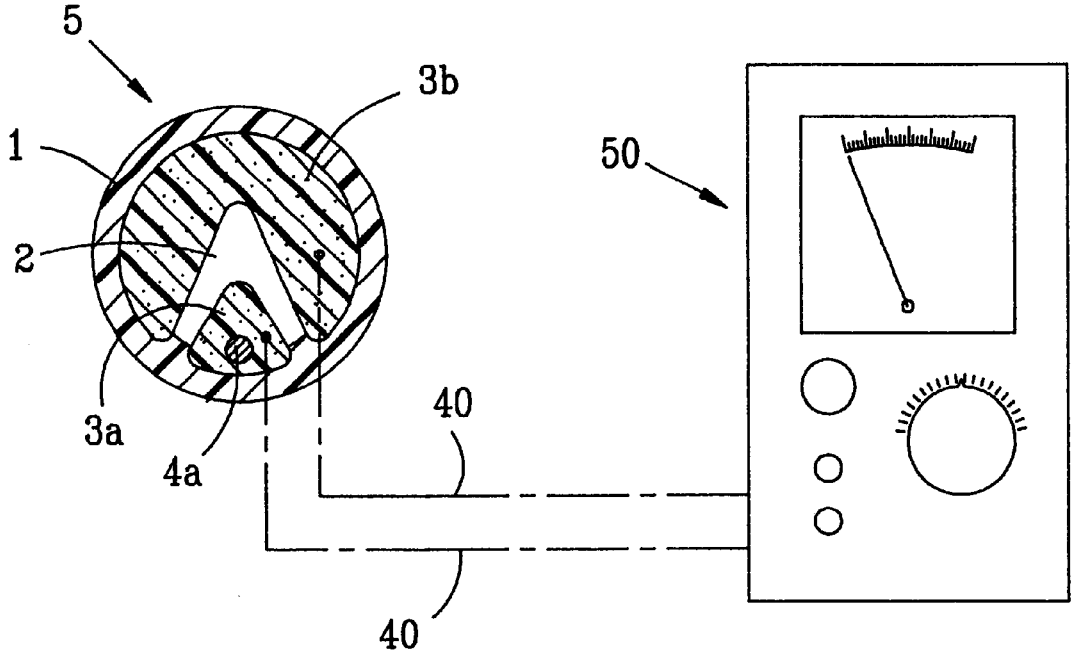
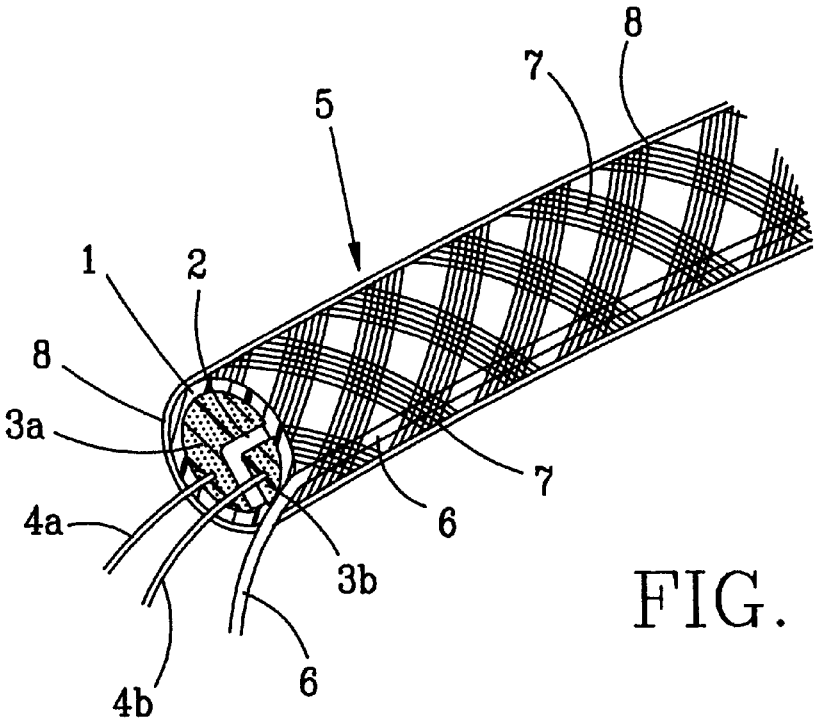
FIG. 14

OMNIDIRECTIONAL RESPONSE CABLE SWITCH

BACKGROUND OF THE INVENTION

This invention relates to a cable switch, more particularly to an omnidirectionally responsive cable switch capable of being wired or laid on a required position in a snake-like or twisted manner.

Cable switches are already described in the official gazettes of Japanese Utility Model Laid-Open Publication No. 77033 as shown in FIG. 16, Japanese Utility Model Laid-Open Publication No. 77035 as shown in FIG. 17 and Japanese Patent Laid-Open Publication No. 5190055 as shown in FIG. 18, respectively of the accompanying drawings.

The Japanese Laid Open Utility Model Publication No. 77033 comprises a restorable tubular cable member 14, two pieces of conductive rubber 12, 12 serving as a contact member, two narrow belt like flat nets of electric wires 11*a*, 11*b* respectively contained in the conductive rubbers 12, 12 and an air gap 13 formed between the conductive rubbers 12, 12.

The Japanese Laid Open Utility Model Publication No. 77035 comprises a restorable cable member 26, an upper bridging electric conductor 24, lower conductive rubbers 22, 22 fixed on the inner surface of the cable member 26 and spaced apart from each other by means of a longitudinal central supporting protrusion 25, and two narrow belt-like flat net of electric wires 21*a*, 21*b* respectively contained in the conductive rubbers 22, 22.

The Japanese Laid Open Patent Publication No. 190055/1993 comprises a tubular insulating member 35, two narrow belt-like cores 31, 31 inserted in the insulating member 35 while leaving an air gap 34 therebetween and two electric wires 32*a*, 32*a* respectively wound on the belt-like cores 31, 31.

These cable switches can be actuated only under substantial compressive pressure in the vertical direction but can not respond to pressure in the horizontal direction owing to their construction.

Further, owing to the same reason, the Japanese Laid Open Utility Model Publication No. 7-7033 is difficult to vertically bend for the purpose of wiring or laying on a required position, while the Japanese Laid Open Utility Model Publication No. 7-7035 and Japanese laid Open Patent Publication No 5-190055 are difficult to be horizontally bent for the same purpose.

Of late, with the development of a nursing robot and the like, it has been required to use such a cable switch that is gentle to patients or invalid persons and can be easily bent omnidirectionally for wiring or laying on the arm or hand of the robot while enabling it to omnidirectionally respond to substantial compressive pressure applied thereto at any point on the cable surface.

The omnidirectionally responsive cable switch can be used, for example, in the site of road construction, maintenance and other works and in such cases where it is often required that the switch be further protected or guarded against possible damage of the embedded conductive rubbers due to violent pull and the like.

SUMMARY OF THE INVENTION

According to a first aspect of the invention, there is provided an omnidirectionally responsive cable switch which comprises a tubular outer cover made of an insulating material and 2–4 separate conductive rubbers fixed by mean of an injection molding technique on the inner surface of the outer cover while leaving therebetween an air gap that is substantially cross-shaped, S-shaped, V-shaped, Y-shaped or arrow-head-shaped, said separate conductive rubbers being apart from each other, said outer cover being capable of being distorted together with the conductive rubbers by substantial compressive pressure from outward so that the separate conductive rubbers may contact with each other thereby forming a contact therebetween.

According to a second aspect of the invention, one or two electric wire(s) pierce respectively through one or two of the conductive rubbers and in the case where only one electric wire is employed there can be observed less electric flow than the case where two wires are employed since the former case is subject to more electric resistance.

According to a third aspect of the invention, the outer cover may be provided on the outer surface with a plurality of longitudinal protrusions for the purpose of stable wiring.

According to a fourth aspect of the invention, the insulating outer cover may be protected or guarded with one or more reinforcing fibers, for example an aramid fiber longitudinally laid thereon for preventing the conductive rubbers from being damaged by strong pull and further said one or more reinforcing fibers may be coated with a reinforcing fiber or reinforcing resin such as silicone.

BRIEF DESCRIPTION OF THE DRAWINGS

Further features of the invention will appear from the following description of various embodiments of the invention given by way of example only and with reference to the drawings, in which:

FIG. 13 is a schematic view showing a seventh embodiment at left side and how the cable switch is connected to an electric power source and a detecting apparatus at right side.

FIG. 14 is a perspective view of an eighth embodiment of the invention with the outer cover protected or guarded by reinforcing members and materials at right side.

DESCRIPTION OF PREFERRED EMBODIMENT

Figure 1:
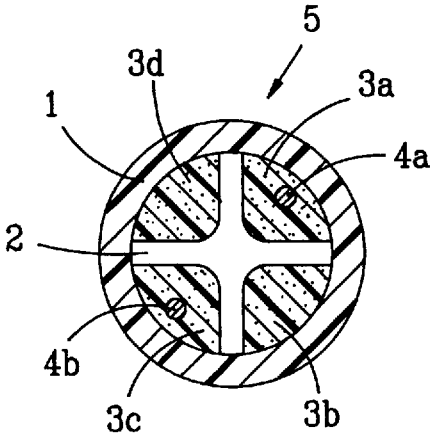
FIG. 1 is a cross-sectional view of a first embodiment of the invention.

Referring to the drawings and firstly to FIGS. 1–4, an omnidirectionally responsive cable switch 5 is shown which comprises an insulating outer cover 1 that is elastic, four separate conductive rubbers 3*a*–3*d* fixed longitudinally on the inner surface of the outer cover 1 by using an injection molding apparatus (not shown) and two conductive stranded wires 4*a*, 4*b* of circular cross-section and piercing through the diagonal conductive rubbers 3*a*, 3*c*.

The four separate conductive rubbers 3*a*–3*d* are spaced apart from each other and there is formed therebetween an air gap 2 which is substantially cross-shaped. The width of the air gap 2 is slightly narrower than that of the outer cover 1.

Figure 3A:
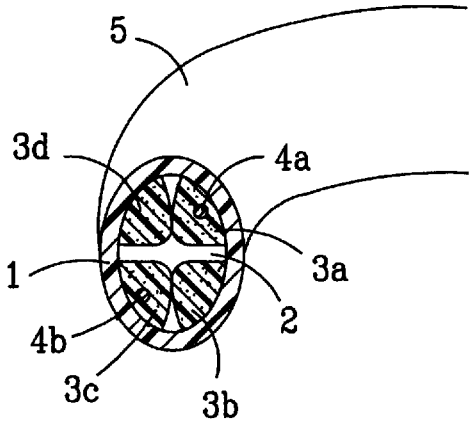
FIG. 3 is a perspective view partly in section of the first embodiment and showing the state where the cable switch is bent in horizontal direction (a) and in vertical direction (b), respectively.
Figure 3B:
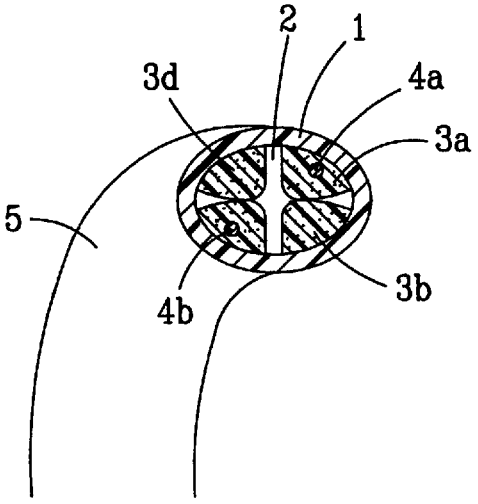

As shown for example in FIG. 3 the omnidirectional cable switch 5 thus formed can be bent with a radius of curvature 15 mm to any direction without impairing its function due to the section-ally circular shape of the conductive wires 4*a*, 4*b*, and unless any compressive outer pressure is applied thereon the cable switch 5 will not function or switch on, since the air gap 2 prevents the conductive wires 4*a*, 4*b* from contacting with each other through the conductive rubbers 3*a*–3*d*.

Figure 4:
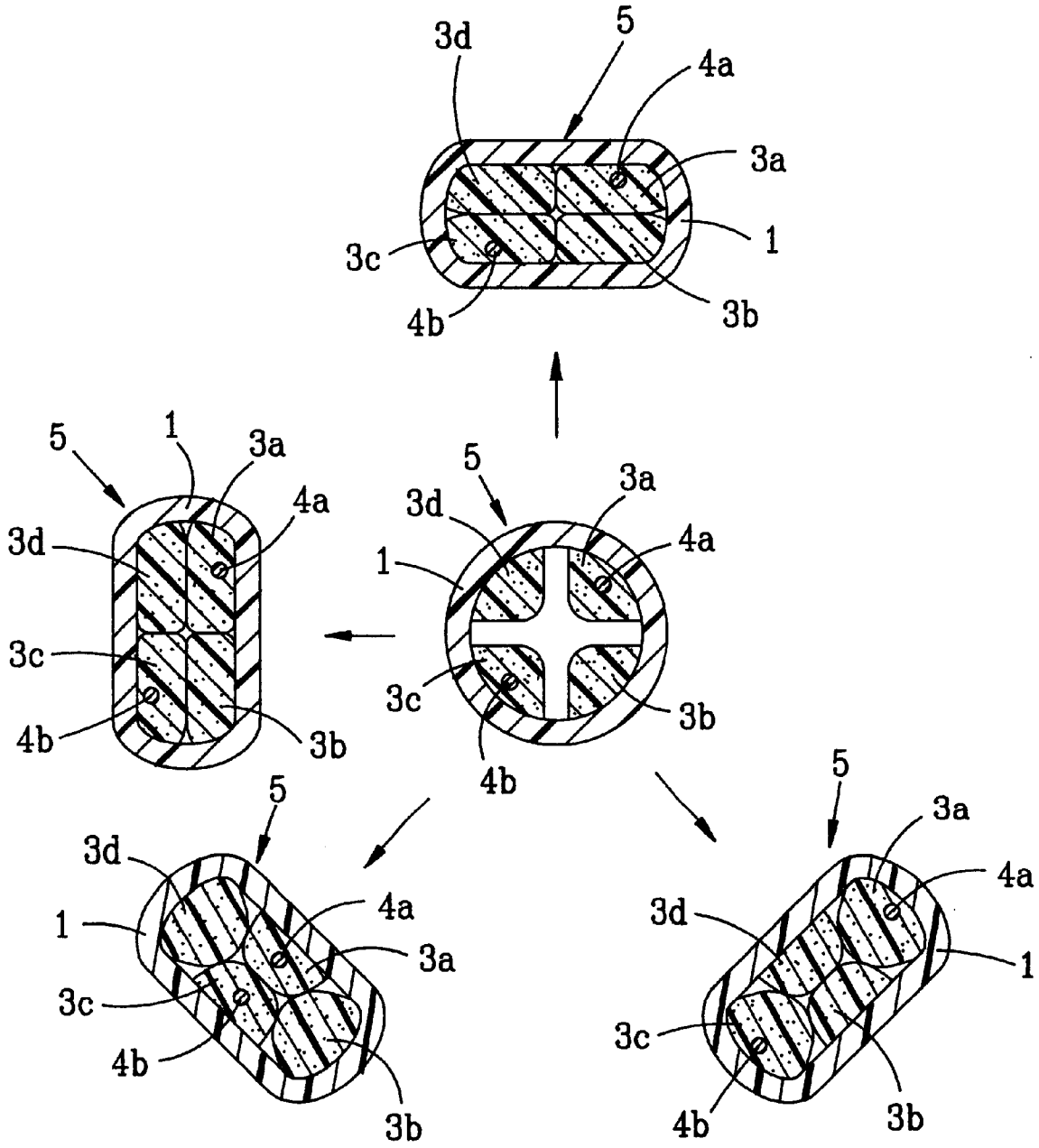
FIG. 4 shows cross-sectional views of the first embodiment with varied states of the cable switch when strong compressive outer pressure is omnidirectionally applied thereto.

As shown in FIG. 4 both the conductive wires 4*a*, 4*b* do not directly contact with each other, but the conductive rubbers 3*a*–3*d* serve to form an electric circuit therebetween due to their conductivity and thus to switch on the cable switch 5 with the conductive wires 4*a*, 4*b* made conductive by the aid of the conductive rubbers.

Figure 2:
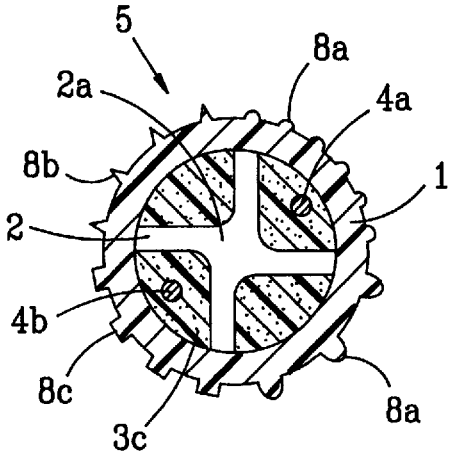
FIG. 2 is a cross-sectional view of a second embodiment of the invention.

FIG. 2 illustrates a second embodiment of the invention similar to that of FIG. 1 but differs in that a plurality of longitudinal protrusions are provided on the outer surface of the cable switch 5.

Figure 5:
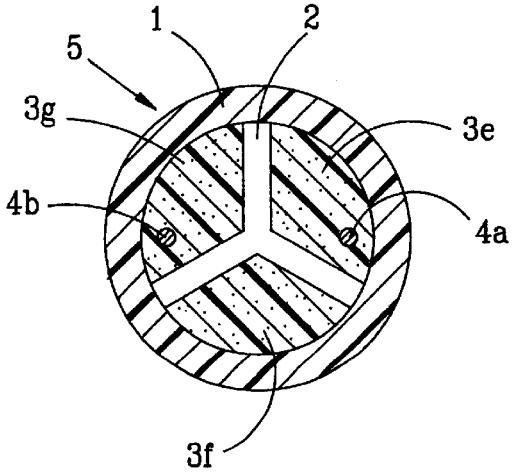
FIG. 5 is a cross-sectional view of a third embodiment of the invention showing a Y-shaped air gap.

Referring now to FIG. 5, there is illustrated an omnidirectionally responsive cable switch according to a third embodiment of the invention.

The embodiment of FIG. 5 differs from those of FIGS. 1, 2 in that the conductive rubbers consist of three pieces 3*e*, 3*f* and 3*g* while the air gap 2 is substantially Y-shaped and slightly narrower than the outer cover 1. The conductive stranded wires 4*a*, 4*b* are embeded in the conductive rubbers 3*e* and 3*g*.

Figure 6:
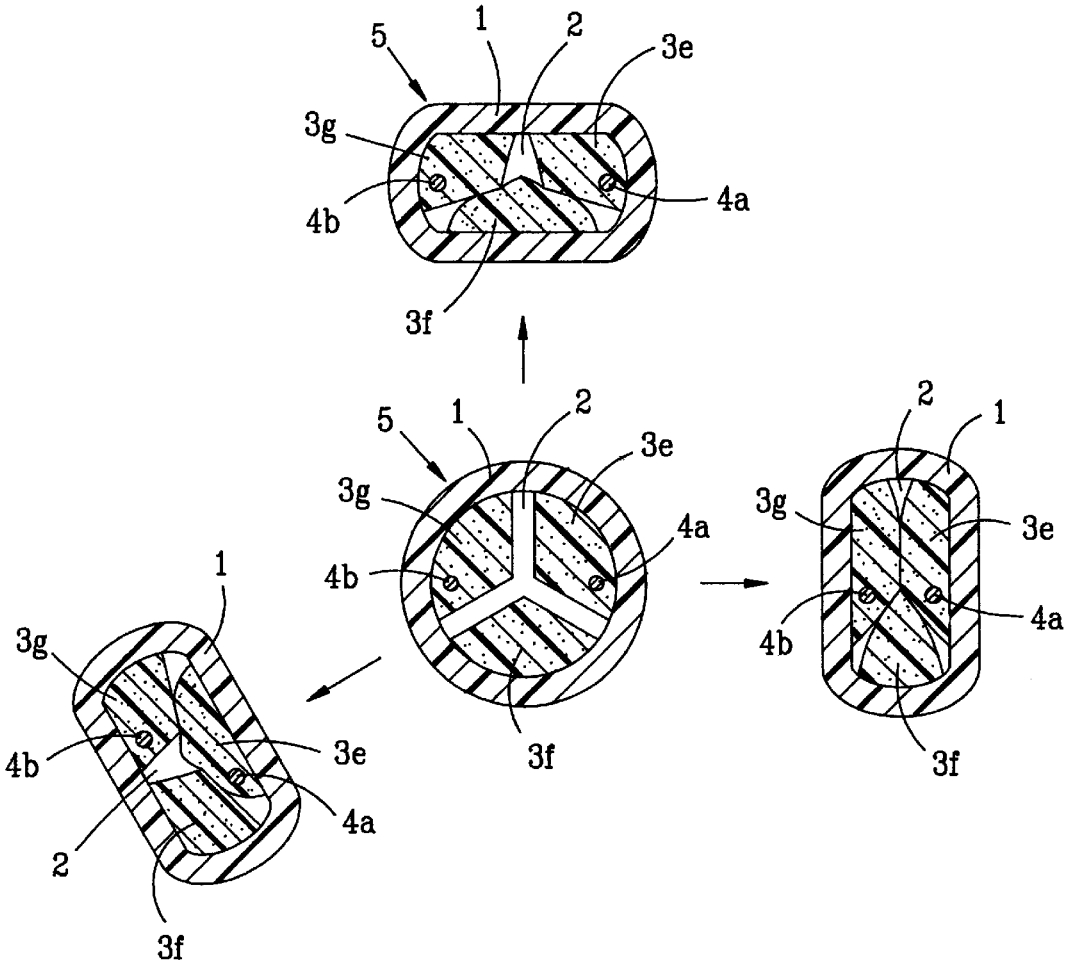
FIG. 6 shows how the cable switch functions with the conductive rubbers squashed with each other when substantial compressive pressure is applied thereto.

FIG. 6 shows how the cable switch 5 is compressed when substantial compressive pressure is applied thereto.

The cable switch 5 is compressed such that the conductive rubbers 3*g* and 3*e* respectively contact with the conductive rubber 3*f* as shown at the upper part thereof, the conductive rubber 3*g* contacts with the conductive rubber 3*e*, and the conductive rubber 3*e* in turn contacts with the conductive rubber 3*f* as shown at the left part, while, the conductive rubbers 3*g*, 3*e* and 3*f* contact with each other as shown at the right part and thus the conductive wires 4*a* and 4*b* are made conductive with each other with the aid of the conductive rubbers 3*e* 3*f*, 3*g*.

Figure 7:
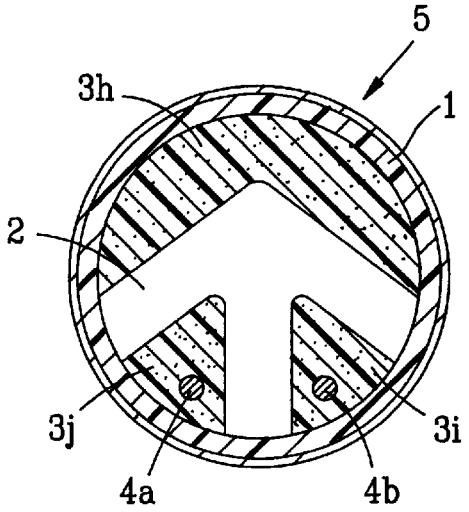
FIG. 7 is a cross-sectional view of a fourth embodiment of the invention showing an arrow-head-shaped air gap.

Next referring to FIG. 7, there is illustrated an omnidirectionally responsive cable switch 5 according to a fourth embodiment and comprising three pieces of conductive rubber 3*h*, 3*i* and 3*j*, an air gap 2 substantially arrow-head-shaped, and two conductive stranded wires 4*a*, 4*b* embedded in the conductive rubbers 3*i*, 3*j*.

Figure 8:
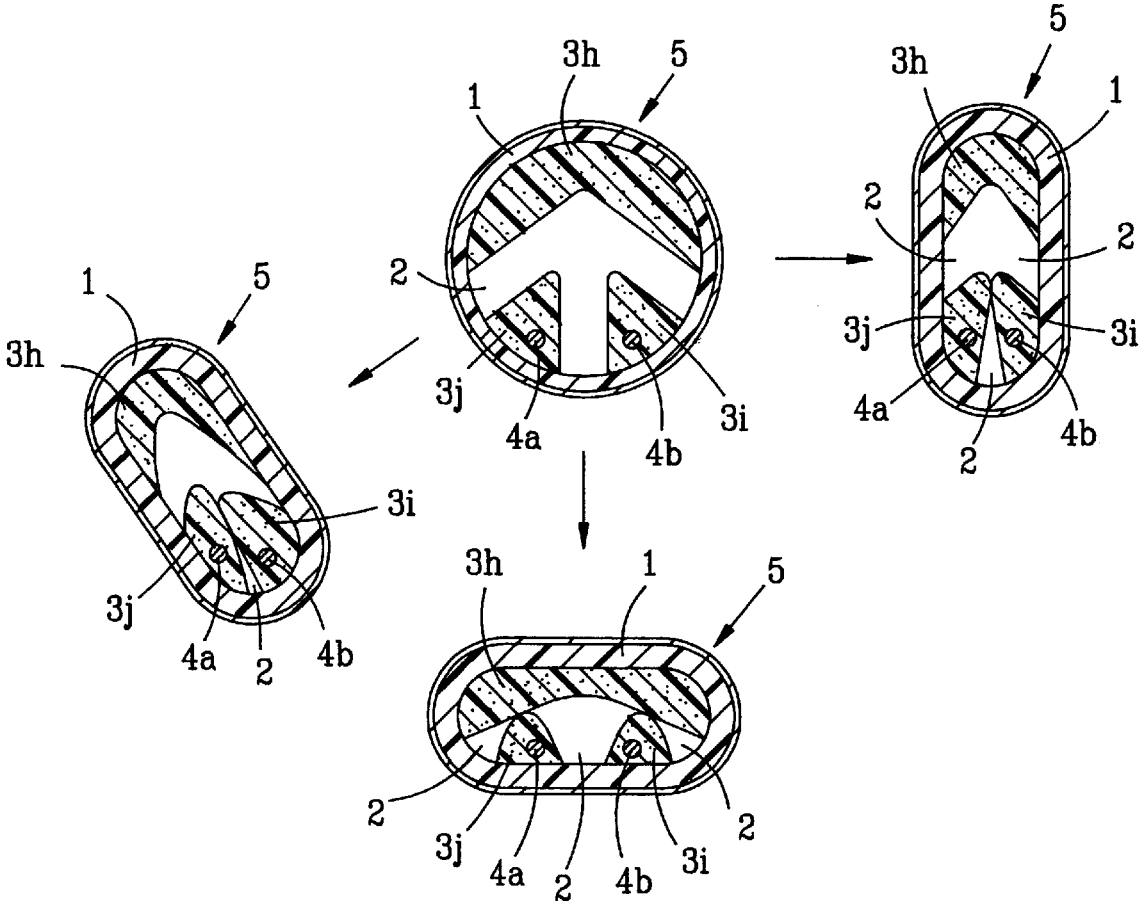
FIG. 8 shows how the cable switch functions with the conductive rubbers squashed with each other when substantial compressive pressure is applied thereto.

FIG. 8 shows how the cable switch 5 shown at upper central part thereof is squashed when a meaningful squashing pressure is applied thereto. In this case, the conductive wires 3*j* and 3*i* respectively embedded in the conductive rubbers 4*a*, 4*b* contact with each other as show at the left and right parts, while the conductive rubbers 3*j* and 3*i* respectively contact with the conductive rubber 3*h* as shown at the lower central part, and thus the conductive wires 4*a*, 4*b* are made conductive with each other.

Figure 9:
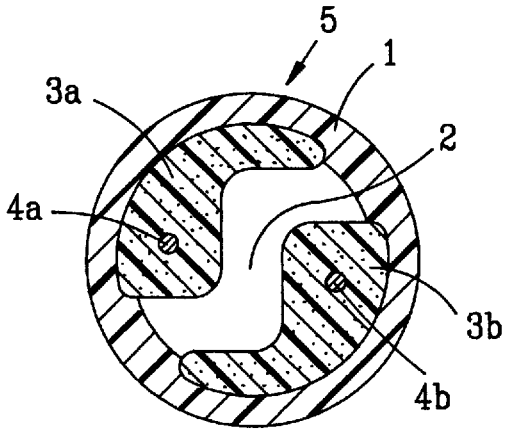
FIG. 9 is a cross-sectional view of a fifth embodiment of the invention showing an S-shaped air gap.

Referring next to FIG. 9, there is illustrated an omnidirectionally responsive cable switch 5 according to a fifth enbodiment of the invention and comprising two conductive rubbers 3*a*, 3*b* respectively embedding therein conductive wires 4*a*, 4*b* and having an S-shaped air gap 2 formed therebetween. The width of the air gap 2 is slightly larger than that of the outer cover 1.

Figure 10:
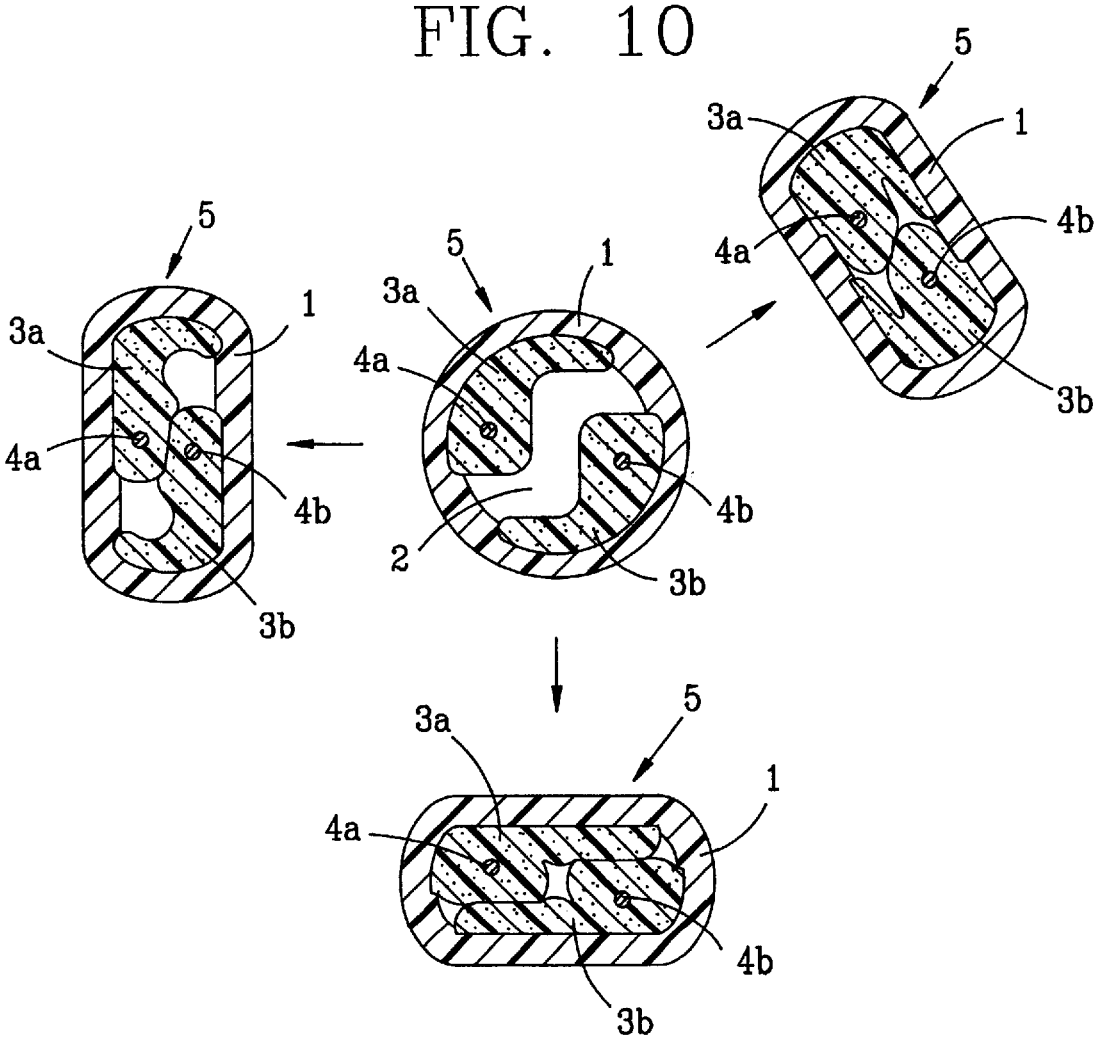
FIG. 10 shows how the cable switch functions with the conductive rubbers compressed against each other when substantial compressive pressure is applied thereto.

FIG. 10 shows how the cable switch 5 shown at the central upper part is compressed when substantial compressive pressure is applied thereto. The conductive rubbers 3*a*, 3*b* are distorted to contact each other and thus the conductive wires 4*a*, 4*b* are made conductive with each other through the conductive rubbers 3*a*, 3*b*.

Figure 11:
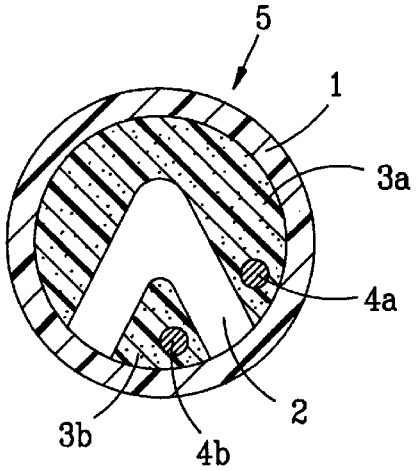
FIG. 11 is a cross-sectional view of a sixth embodiment of the invention showing a V-shaped air gap.

Further referring to FIG. 11, there is illustrated an omnidirectionally responsive cable switch 5 according to a sixth embodiment of the invention and having a substantially V-shaped air gap 2.

Figure 12:
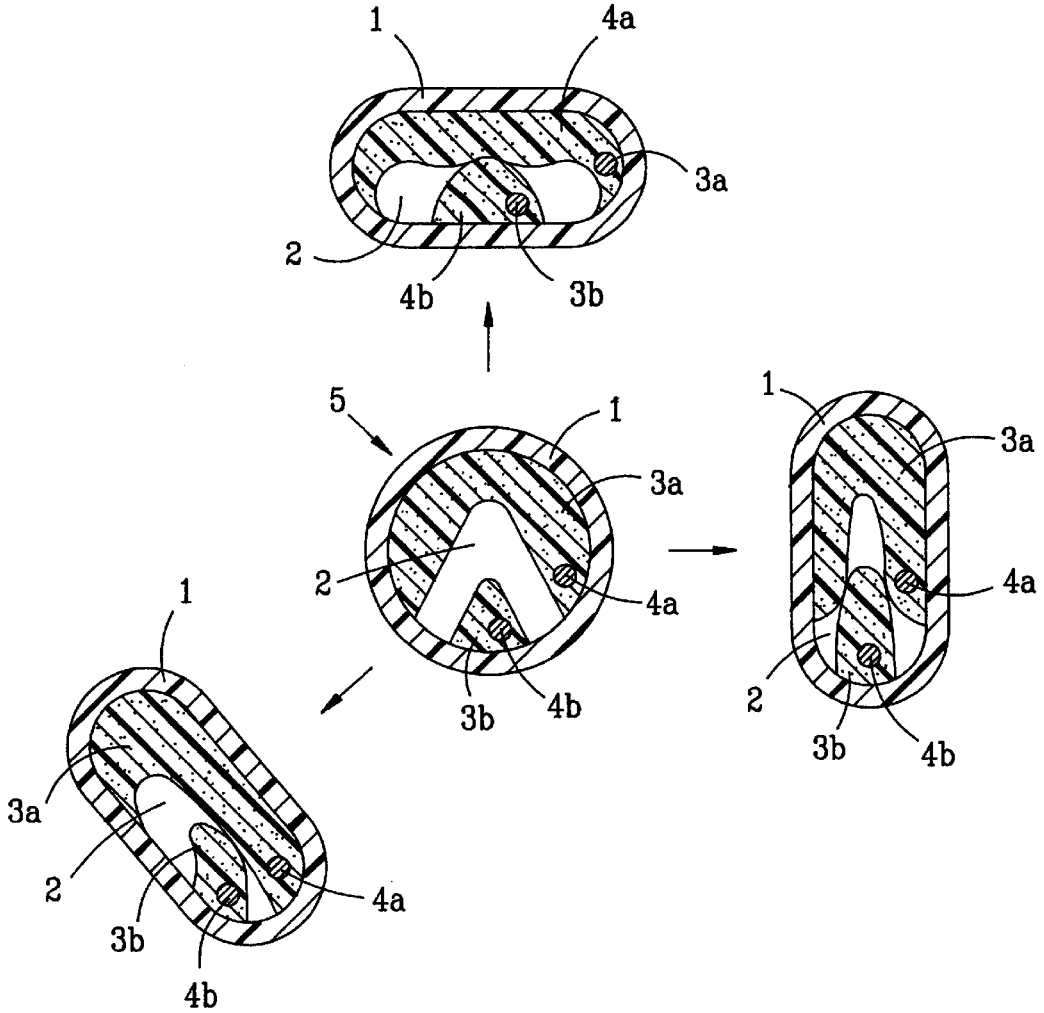
FIG. 12 shows how the cable switch functions with the conductive rubbers compressed against each other when substantial compressive pressure is applied thereto.

FIG. 12 shows how the cable switch shown at the central part is distorted or compressed when substantial compressive pressure is applied thereto. Also in this case, the conductive rubbers 4*a*, 4*b* contact with each other in a different manner respectively shown in the left, upper and right parts and thus the conductive wires 4*a*, 4*b* are made conductive with each other through the conductive rubbers 3*a*, 3*b*.

FIG. 13 shows at left part an omnidirectionally responsive cable switch 5 comprising two conductive rubbers 3*a*, 3*b* and only one conductive wire 4*a* embedded in one of the conductive rubbers 3*a*, 3*b*.

Although the cable switch 5 of FIG. 13 is shown as having a similar shape to that of FIG. 11 but lacking the conductive wire 4*b*, this arrangement which lacks the conductive wire 4*b* can apply to all of the abovementioned embodiments of FIGS. 1, 2, 5, 7 and 9.

In this case, the conductive wire 4*a* contacts with the conductive rubber 3*b* through the conductive rubber 3*a* when substantial compressive pressure is applied thereto and thus both the conductive wire 4*a* and the conductive rubber 3*b* are made conductive with each other.

Taking this chance, the connection of the cable switch 5 to an electric power source and other detecting apparatus as generally illustrated by 50, for example in the right part of FIG. 13 as will be explained below.

The cable switch 5 is connected through lead wires 40, 40 to the above apparatus 50.

When the conductive wires 4*a,* 4*b* or, in case of only one conductive wire 4*a* is employed, said conductive wire 4*a* and the conductive rubber 3*b* are made conductive with each other with substantial compressive pressure applied to the cable switch 5, electricity runs through the lead wires 40, 40 to the electric apparatus 50 which can detect the electricity running through the cable switch 5. In the case of FIG. 13 which has only one conductive wire 4*a,* due to the difference of electric conductivity between the conductive wire 4*a* and the conductive rubber 3*b,* the electricity running through the cable switch 5 is less compared with those in the case of FIGS. 1, 2, 5, 7, 9 and 11 where the two conductive wires 4*a,* 4*b* are employed. Accordingly, it can be detected where the compressive pressure is applied on the cable switch 5 by calculating the amount of electricity running through the cable switch 5.

Figure 15:
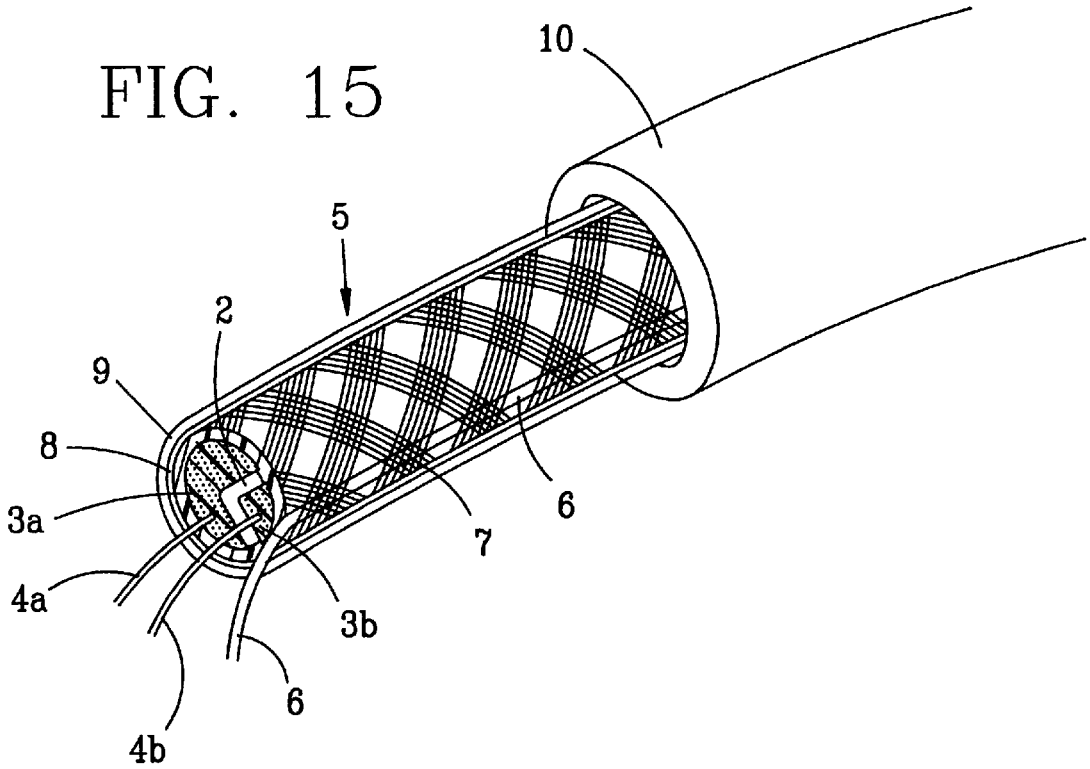
FIG. 15 is a perspective views showing the cable switch of FIG. 14 inserted in a protective tube.
Figure 16:
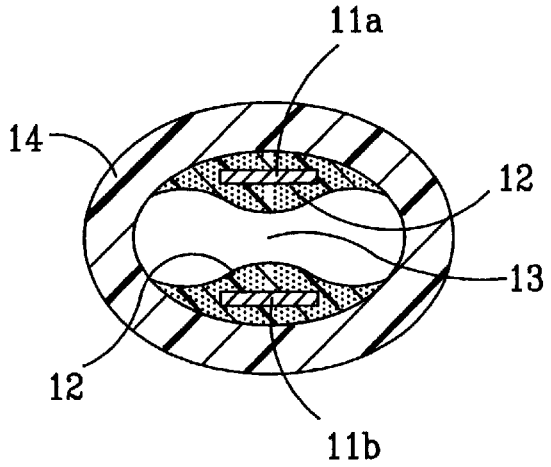
FIG. 16 PRIOR ART
FIGS. 16–18 show the prior art cable switches as briefly described before.
Figure 17:
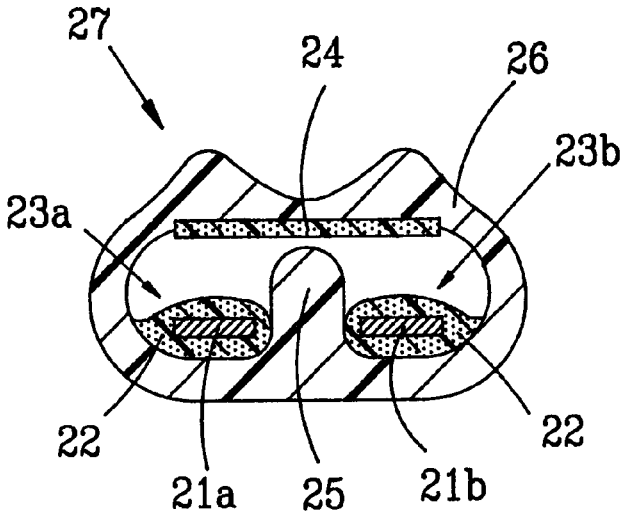
FIG. 17 PRIOR ART
Figure 18:
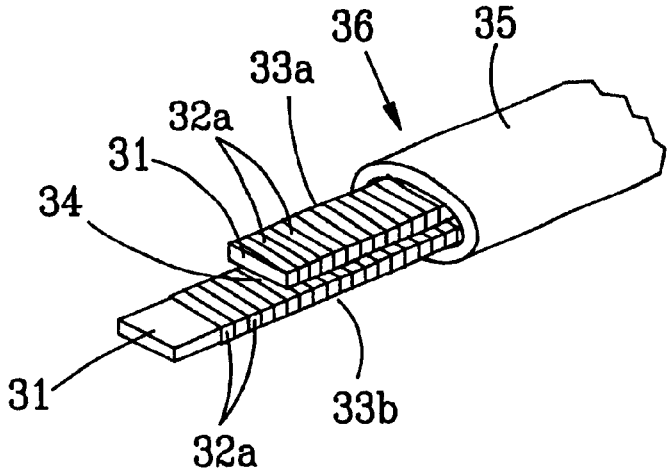
FIG. 18 PRIOR ART

Referring last to FIGS. 14, 15, there is illustrated an omnidirectionally responsive cable switch 5 according to an eighth embodiment of the invention which further comprises one or more reinforcing aramid fibers 6 longitudinally laid on the outer surface of the outer cover 1. However, since the reinforcing aramid fiber 6 can not be bonded on the outer cover 1 as it is, a reinforcing glass fiber 7 is knitted thereon and further coated with a reinforcing silicone 8 in order to strengthen the cable switch 5.

FIG. 15 shows that a protective film 9 is further laid on the surface of the reinforcing silicone 8 for the purpose of protecting the outer face of the cable switch 5 thus reinforced when it is inserted into a protective tubular member 10.

What is claimed is:

1. An omnidirectionally responsive cable switch which comprises a tubular outer cover made of an insulating material and two separate conductive rubbers of irregular shape, said separate conductive rubbers being fixed on the inner surface of the outer cover leaving an air gap therebetween, said separate conductive rubbers being apart from each other, and said outer cover being capable of being distorted together with the conductive rubbers so that the separate conductive rubbers contact each other when compressive pressure from any direction is applied thereto at any point on the outer cover, thereby forming a switching contact therebetween, said air gap being substantially S-shaped in cross-sectional view having two portions extending towards the outer cover and a third portion interconnecting said two portions, said two portions and said third portion being of substantially uniform width.

2. An omnidirectionally responsive cable switch according to claim 1, wherein the cable switch includes two electric wires, and each of the electric wires pierces through one of the separate conductive rubbers.

3. An omnidirectionally responsive cable switch which comprises a tubular outer cover made of an insulating material and four separate conductive rubbers, said separate conductive rubbers being fixed on the inner surface of the outer cover leaving an air gap between every two of said four separate conductive rubbers, said separate conductive rubbers being apart from each other, and said outer cover being capable of being distorted together with the conductive rubbers so that the separate conductive rubbers contact each other when compressive pressure from any direction is applied thereto at any point on the outer cover, thereby forming a switching contact therebetween, said air gap being substantially cross-shaped in cross-sectional view.

4. An omnidirectionally responsive cable switch according to claim 3, wherein a plurality of longitudinal protrusions are provided on the outer surface of the outer cover for the purpose of ensuring a stable wiring or lay out.

5. An omnidirectionally responsive cable switch which comprises a tubular outer cover made of an insulating material and three separate conductive rubbers, said separate conductive rubbers being fixed on the inner surface of the outer cover leaving an air gap between every two of said three separate conductive rubbers, said separate conductive rubbers being apart from each other, and said outer cover being capable of being distorted together with the conductive rubbers so that the separate conductive rubbers contact each other when compressive pressure from any direction is applied thereto at any point on the outer cover, thereby forming a switching contact therebetween, said air gap being substantially Y-shaped in cross-sectional view.

6. An omnidirectionally responsive cable switch which comprises a tubular outer cover made of an insulating material and two separate conductive rubbers, said separate conductive rubbers being fixed on the inner surface of the outer cover leaving an air gap therebetween with one of said two conductive rubbers having two equal length sides and the other of said two conductive rubbers having two equal length sides, said separate conductive rubbers being apart from each other, and said outer cover being capable of being distorted together with the conductive rubbers so that the separate conductive rubbers contact each other when compressive pressure from any direction is applied thereto at any point on the outer cover, thereby forming a switching contact therebetween, said air gap being substantially V-shaped in cross-sectional view.

7. An omnidirectionally responsive cable switch according to claim 6, wherein the cable switch includes only one electric wire, and the electric wire pierces through one of the separate conductive rubbers.

8. An omnidirectionally responsive cable switch which comprises a tubular outer cover made of an insulating material and three separate conductive rubbers, said separate conductive rubbers being fixed on the inner surface of the outer cover leaving an air gap between every two of said three separate conductive rubbers, said separate conductive rubbers being apart from each other, and said outer cover being capable of being distorted together with the conductive rubbers so that the separate conductive rubbers contact each other when compressive pressure from any direction is applied thereto at any point on the outer cover, thereby forming a switching contact therebetween, said air gap having a shape of an arrowhead.

9. An omnidirectionally responsive cable switch which comprises a tubular outer cover made of an insulating material and 2–4 separate conductive rubbers, said separate conductive rubbers being fixed on the inner surface of the outer cover leaving an air gap therebetween, said separate conductive rubbers being apart from each other, and said outer cover being capable of being distorted together with the conductive rubbers so that the separate conductive rubbers contact each other when compressive pressure from any direction is applied thereto at any point on the outer cover, thereby forming a switching contact therebetween, a reinforcing member and a reinforcing material being fixedly laid on the outer surface of the outer cover for the purpose of protecting or guarding the cable switch, the reinforcing member being one or more aramid fibers longitudinally laid on the outer surface of the outer cover and the reinforcing material being at least one knitted glass fiber further coated with silicone.

10. An omnidirectionally responsive cable switch which comprises a tubular outer cover made of an insulating material and at least two separate conductive rubbers, said separate conductive rubbers being fixed on the inner surface of the outer cover leaving an air gap between every two separate conductive rubbers, said separate conductive rubbers being apart from each other, and said outer cover being capable of being distorted together with the conductive rubbers so that the separate conductive rubbers contact each other when compressive pressure from any direction is applied thereto at any point on the outer cover, thereby forming a switching contact therebetween, said air gap being of substantially uniform width.

* * * * *